US005544364A

United States Patent [19]

Weber

[11] Patent Number: 5,544,364

[45] Date of Patent: Aug. 13, 1996

[54] NURSING APRON

[76] Inventor: Joan Weber, 2916 Chiplay St., Sacramento, Calif. 95826

[21] Appl. No.: 398,167

[22] Filed: Mar. 2, 1995

[51] Int. Cl.[6] ..... A41D 1/20; A41D 1/22; A41D 13/04

[52] U.S. Cl. ..... 2/104; 2/48; 2/51

[58] Field of Search ..... 2/1, 46, 48, 49.1, 2/49.2, 49.3, 49.4, 49.5, 50, 51, 52, 104, 105, 106, 113, 114, 115, 75, 80

[56] References Cited

U.S. PATENT DOCUMENTS

| | | | |
|---|---|---|---|
| 4,106,122 | 8/1978 | Dodd | 2/104 |
| 4,651,349 | 3/1987 | Heiler | 2/104 |
| 4,924,528 | 5/1990 | Trombetti-Dickens | 2/104 |
| 4,987,612 | 1/1991 | Middleton | 2/104 |
| 5,034,999 | 7/1991 | Lubbers | 2/104 |
| 5,182,813 | 2/1993 | Booze | 2/104 |
| 5,259,068 | 11/1993 | Carroll | 2/104 |

*Primary Examiner*—Jeanette E. Chapman

[57] ABSTRACT

A nursing apron for use by a mother breast-feeding her infant in public is disclosed. The apron is formed of fabric material and is designed to cover the mother's upper torso and the nursing infant. The apron is secured around the mother by means of a neck band with attachment devices. A transparent ventilated viewing panel located across the upper front portion of the apron provides improved ventilation for the nursing infant while covered. The panel's upper location also allows the mother and infant convenient non-obstructed viewing of each other. Additional features of the apron include an opaque skirt with vertical openings juxtaposing each breast for quick easy access to the nursing infant.

8 Claims, 2 Drawing Sheets

NURSING APRON

BACKGROUND OF THE INVENTION

1. Field of the Invention

The present invention relates to devices designed to aid in the privacy of nursing mothers. More particularly, the invention relates to a nursing apron with improved viewing and ventilation features. The apron allows the nursing mother to conveniently and discreetly breast-feed her infant in public places.

2. Description of the Prior Art

There have been several devices designed to aid mothers nursing their infants in public. Most of these prior inventions are nursing garments designed to be worn as personal clothing by the mother. The following U.S. Patents would be included in this category: U.S. Pat. No. 890,614 issued Culver 6/1908; U.S. Pat No. 1,206,480 issued Stagg 11/1916; U.S. Pat. No. 4,004,294 issued Pinch 1/1977; U.S. Pat. No. 4,566,136 issued Echols 1/1986; U.S. Pat. No. 4,601,068 issued Frechette 7/1986; and U.S. Pat. No. 4,663,782 issued Knox et al 5/1987. One disadvantage of these prior art devices is that they establish the need the mothers to purchase more than one nursing garment. This aspect of the design imposes a financial hardship on women who can't afford special nursing apparel. Nursing garments also cream privacy problems for mothers since the garments do not completely conceal the mother's exposed breast from public view. An additional disadvantage of these prior art garments is that they do not efficiently warm or shield the nursing infant and mother from elements in the environment.

Other prior art devices for nursing mothers are nursing blankets or shawls. These devices are designed to drape over the mother's shoulder and personal clothing for the purpose of covering the mother's breast and the infant's head. The following U.S. Patents would be included in this category: U.S. Pat. No. 4,468,816 issued Kaufer 9/1984; U.S. Pat. No. 4,712,251 issued Cobble 12/1987; U.S. Pat. No. 4,964,172 issued Bollard 10/1990; U.S. Pat. No. 5,008,960 issued Hemming 4/1991; and U.S. Pat. No. 5,038,411 issued to St. Armand 8/1991. Since these prior art devices can be draped over any style of woman's clothing, they address the economic concerns of women. A disadvantage of these devices is that they inconveniently require the mother to move the blanket or shawl from one shoulder to another when shifting the nursing infant from one breast to another. This procedure is a particular issue with the St. Armand design since the blanket actually clamps onto the mother's clothing and must be unclasped to be moved. Such a maneuver is not only inconvenient, it also causes undue wear on the mother's clothing. Another disadvantage of these prior art garments is that they open to the center and side of the mother's body and consequently require the mother to move cautiously so that the blanket or shawl will not slip and publicly expose her breast.

The type of prior art designs that most relate to the present invention are nursing covers worn over the mother's clothing. Said designs cover the mother's entire upper torso from the front, over the arms, and around the back. These covers are designed to conceal the mother's breasts and the nursing infant from public view. The following U.S. patents are felt to be related to the present invention, but in no way disclose the present invention; U.S. Pat. No. 4,995,116 issued Beuchamp et al. 2/1991; U.S. Pat. No. 5,034,999 issued Lubbers 7/1991; U.S. Pat. No. 5,259,068 issued Carroll 11/1993. These three prior art inventions have in common the feature of portal pockets for viewing the nursing infant. One disadvantage of the portal pockets is that the mother must free one of her hands and manually force the pockets open with her fingers to view the infant. Such a process is not only awkward, it also impedes the mother's viewing of the nursing infant. Another disadvantage of the portal pocket feature is that the infant's face is completely covered with opaque material when the pockets are closed. These portal closures not only inhibit convenient intimate viewing of the infant and the mother, they also inhibit the flow of air circulation for the nursing infant. The Carroll patent is unique in that its upper panel is made of opaque eyelet material for ventilation. Since eyelet material consists of small embroidered holes (approximately 0.2 cm in dia.) spaced sparsely throughout the fabric, air circulation for the covered infant is only increased a small amount. The present nursing invention provides a nursing apron that has improved upon these and other features seen in prior art.

SUMMARY OF THE INVENTION

1 . Brief Description

The nursing apron is formed of the three following separate segments: 1) a neck band which attaches the apron around the mother's neck, 2) a ventilated viewing panel which is located across the top front portion of the apron, and 3) an opaque skirt covering the sides and the mid-section of the mother's torso. When constructed, the nursing apron drapes over the mother's torso and covers her upper chest to mid-hip region, her shoulders and arms, and a portion of her back. The apron when worn, allows the woman to adjust her clothing underneath the cover so she can expose her breast and feed her infant discreetly and in an inconspicuous manner. The nursing apron can be used in places such as restaurants, airports, places of worship and other public areas.

A unique component of the nursing apron is its ventilated viewing panel. The viewing panel is made of transparent fabric and is located across the mother's upper chest to provide improved viewing and ventilation features. The opaque skirt has three overlapping panels that create fullness in the apron for unconfined movement beneath the skirt. The overlapping panels juxtapose the mother's breasts and provide her two vertical openings for quick easy access to the infant. Additionally, the opaque panels warm and shield the nursing infant from direct sunlight, cool drafts of air, and distractions in the surrounding environment.

2. Objects and Advantages

The present invention overcomes deficiencies seen in prior art. Accordingly, several of the present invention's advantages and objects are:

(a) to provide a nursing apron that offers the mother and the nursing infant privacy.

(b) to provide a nursing apron that efficiently warms and shields the mother and the nursing infant from elements and distractions in the environment.

(c) to provide a nursing apron with improved air circulation for the infant when covered.

(d) to provide a nursing apron with a transparent viewing panel that enables both the mother and the infant to easily and continuously view one another.

(e) to provide a nursing apron with attachment devices that are easy to adjust and that can remain fastened once their desired setting is determined.

(f) to provide a nursing apron with vertical openings over each breast that easily open when the infant needs quick attention.

(g) to provide a nursing apron that is economical and that does not wear on the mother's underlying clothing.

(h) to provide a nursing apron that allows the mother a full range of movement without exposing her breast to public view when nursing.

These and other objects and advantages of the present invention will become readily apparent upon further review of the following specifications and drawings.

| | | | |
|---|---|---|---|
| 6 | nursing apron | 7 | mother |
| 8 | nursing infant | 9 | mother's exposed breast |
| 10 | ventilated viewing panel | 10a | ventilated viewing panel, top |
| 10b | ventilated viewing panel, bottom | 11 | neck band |
| 11a | neck band, bottom | 12 | left cover panel as worn by mother |
| 12a | left cover panel, top | 12b | left cover panel, back |
| 12c | left cover panel, bottom | 12d | left cover panel, front |
| 13 | front cover panel | 13a | front cover panel, top |
| 13b | front cover panel, mother's left side | 13c | front cover panel, bottom |
| 13d | front cover panel, mother's right side | 14 | right cover panel as worn by mother |
| 14a | right cover panel, top | 14b | right cover panel, front |
| 14c | right cover panel, bottom | 14d | right cover panel, back |
| 15 | right end of neck band with buttons | 16 | left end of neck band with buttonholes |
| 17a | left shoulder gathers | 17b | right shoulder gathers |
| 18 | pinch pleat | 19 | opaque skirt |

DESCRIPTION OF THE PREFERRED EMBODIMENT

Figure 1:
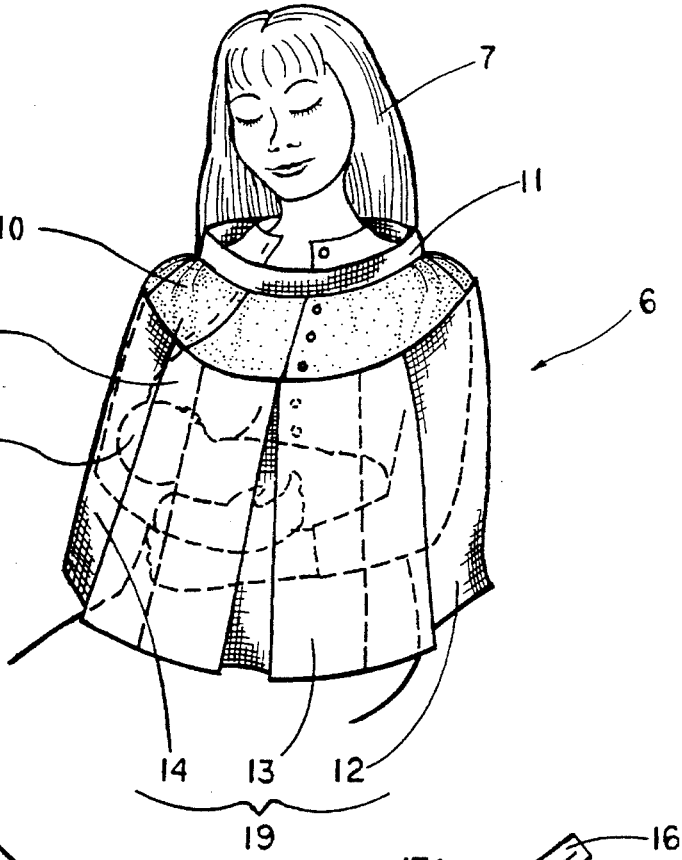
FIG. 1 is a front perspective view of the preferred embodiment of the nursing apron as worn by a mother breast-feeding her infant.

The present invention 6 is illustrated in FIG. 1 showing it in use by a mother 7 breast-feeding her infant 8. The nursing apron 6 consists of the following three parts which will be interconnected by stitching or other suitable means: a ventilated viewing panel 10 which extends across the mother's upper chest, a neck band 11 which rests on the mother's shoulders at the base of her neck, and an opaque skirt 19 comprised of three cover panels 12, 13, and 14 which drape down over the sides and the mid-section of the mother's torso. Panel 12 is located on the mother's left side, panel 13 is located down the mother's front, and panel 14 is located on the mother's right side. Panels 12, 13, and 14 are designed to conceal the mother's exposed breast 9 and the nursing infant 8 before, during and after breast-feeding. Panels 12, 13, and 14 are also designed to warm and protect the infant 8 and the mother 7 from elements in the environment. When constructed the present invention will form a nursing apron 6 that completely covers the mother's upper chest to mid-hip region, her shoulders and arms, and a portion of her back.

Figure 2:
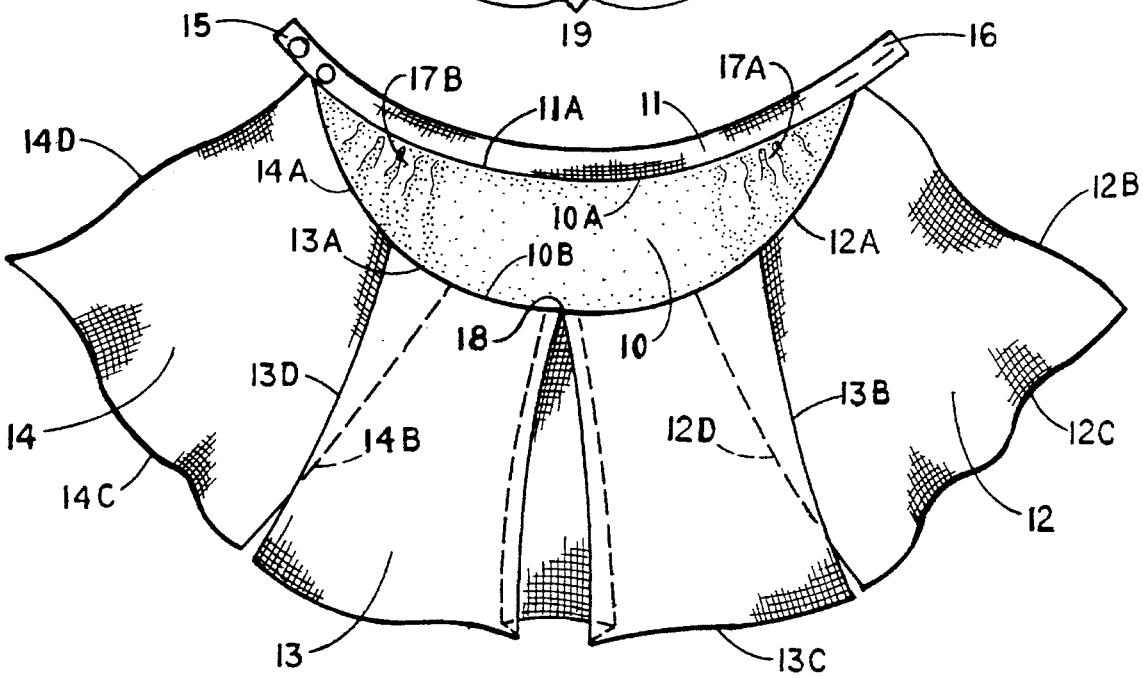
FIG. 2 is a front view of the preferred embodiment of the nursing apron.

The front of the nursing apron laid flat is illustrated in FIG. 2. The preferred embodiment of neck band 11 is shown in FIG. 2 as a long piece of fabric not less than 12.7 cm (5 in.) and not more than 152 cm (60 in.) in length and not less than 15.2 cm (6 in.) and not more than 0.64 cm (0.25 in.) in width. The fabric is made of a durable material that is breathable and comfortable for sensitive skin. Neck band 11 contains a single horizontal row of two to three buttons for attaching the apron loosely around the base of the mother's neck. This type of attachment allows adjustments in the garment's fitting and adds attractive decoration to the back of the apron. Other types of neck band attachment could be: a) use of metal or plastic straps, b) use of releasable adhesive closure strips known as Velcro, or c) use of ties. The bottom edge 11*a* of neck band 11 shall be attached to viewing panel 10 along its top edge 10*a*. The right end of neck band with buttons 15 extends past the back edge 14*d* of panel 14 approximately 10 cm (4 in.). The left end of neck band with buttonholes 16 extends past the back edge 12*b* of panel 12 approximately 10 cm (4 in.). When the ends 15, 16 of neck band 11 are attached, the neck band creates an enclosed circle. As shown in FIG. 1, neck band 11 when fastened is designed to fall easily over the mother's head and rest on her shoulders. Once the desired circumference of neck band 11 is set, the mother will not need to undo and refasten the apron attachment every time she uses it.

Figure 3:
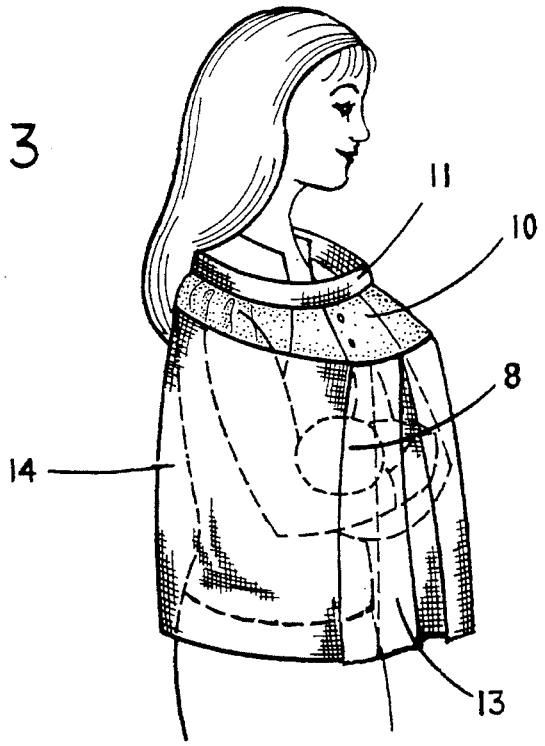
FIG. 3 is a side perspective of the preferred embodiment of the nursing apron as worn by a mother breast-feeding her infant.

The preferred embodiment for viewing panel 10 is a piece of fabric not more than 254 cm (100 in.) and not less than 25.4 cm (10 in.) in length and not more than 38 cm (15 in.) and not less than 2.54 cm (1 in.) in width. The viewing panel 10 is interconnected with the bottom edge of neck band 11*a* and the top edges of cover panels 12*a*, 13*a*, and 14*a*. Viewing panel 10 has left shoulder gathers 17*a* and right shoulder gathers 17*b* along viewing panel's top edge 10*a* where the apron falls over the mother's shoulders. The shoulder gathers 17*a* and 17*b* allow the apron 6 to contour the mother's body. Viewing panel 10 is made of a fabric classified by the garment industry as "sheers" which usually consists of polyester or nylon material woven loosely to create a transparent sheet. As shown in FIG. 3, the top location of viewing panel 10 provides the mother and infant non-obstructed downward and upward viewing of each other through a plane the fabric covers. Additionally, the very porous quality of the sheer fabric provides improved ventilation for the covered infant. Viewing panel 10 could also be made of other transparent fabrics such as nylon net, polyester lace or lace made of cotton-polyester blends.

The opaque skirt 19 as shown in FIG. 1 is comprised of three cover panels 12, 13 and 14 and is made of natural cotton blend material. The skill could be made of either lightweight cotton for warm weather conditions or heavier flannel cotton for cool weather conditions. In FIG. 2, the three cover panels 12, 13, and 14 have top edges 12*a*, 13*a*, and 14*a* which extend downward from the bottom edge 10*b* of panel 10 approximately 51 cm (20 in.) to their respective bottoms 12*c*, 13*c* and 14*c*. The back edges 12*b* and 14*d* of panels 12 and 14 extend inward approximately 63.5 cm (25 in.) to their respective front edges 12*d* and 14*b* and are overlapped approximately 15.2 cm (6 in.) by panel 13. The top of panel 13 has pinch pleat 18 located in the center of 13*a* to add fullness to the apron. Panel 13 extends from pinch pleat 18 approximately 25.4 cm (10 in.) to its right side 13*d* and approximately 25.4 cm (10 in.) to its left side 13*b*. In FIG. 3 it can also be seen that panel 13 and panel 14 overlap one another and juxtapose the mother's fight breast next to the infant's head 8. The overlapping feature of panels 13 and 14 provides the mother a vertical opening for quick and easy access to the nursing infant. Panels 13 and 12 provide the same vertical opening feature for the mother's left breast.

Figure 4:
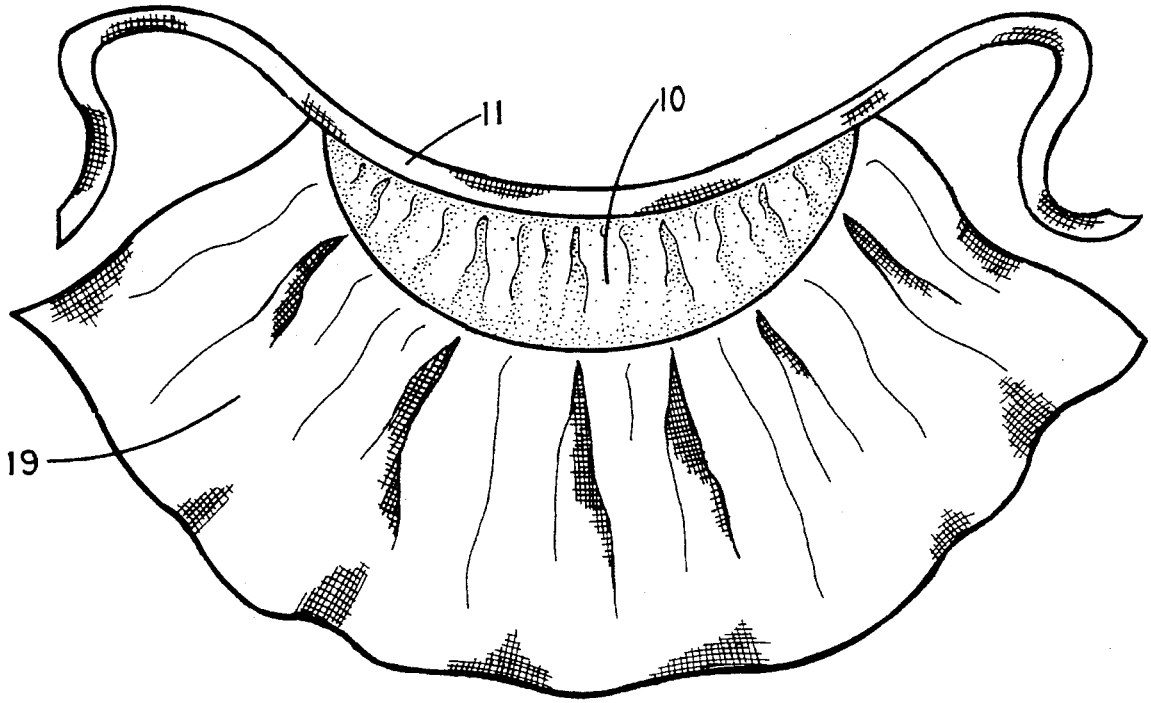
FIG. 4 is a front view of a modified nursing apron.

It is intended that more than one size or style of nursing apron will be produced to accommodate the various sizes, shapes, and personal tastes of women. This is the reason for the approximate measurements of the apron parts listed above. FIG. 4 is an illustration of a modified nursing apron that demonstrates one possible variation of the apron style. The apron shown here embodies the same elementary components of any nursing apron: a neck band, a ventilated viewing panel, and an opaque skirt. In this particular design, a tie is utilized as the preferred attachment device. The ends of the neck band in this embodiment have been extended so a large bow will secure the apron around the mother's neck. Additionally, the ventilated viewing panel and the opaque skirt both have gathers along their top edges to create a much fuller apron. Due to the sufficient fullness of the apron, this skirt would be made of one continuous piece of fabric. This style of nursing apron would be advantageous for fuller figured mothers. The elimination of the separated panels and vertical openings would also offer women a more modest choice of apron design.

It is to be understood that the present invention is not limited to the sole embodiments described above, but encompass any and all embodiments within the scope of the following claims.

I claim:

1. A nursing apron for covering the upper portion of a mother's body and an infant during the act of breast-feeding, comprising:

(a) a neck band, said neck band having first and second ends and top and bottom edges, said neck band including cooperating attachment means located at each end for closure of said neck band to secure the apron around the mother's neck and vary the size of the apron;

(b) a ventilated transparent viewing panel, said viewing panel having top and bottom edges, said viewing panel affixed to and extending downward from the bottom edge of said neck band, said viewing panel disposed to extend across the mother's upper chest below the neck, between her shoulders and above her breasts, and to cross the mother's line of sight from her eyes to her breasts; and (c) an opaque skin, said skin affixed to the bottom edge of said viewing panel, said skirt draping downward from said viewing panel and disposed to cover at least the mother's middle front torso region and her infant during the act of breast feeding, wherein said viewing panel allows the mother downward unobstructed viewing of the infant and the infant upward unobstructed viewing of the mother and wherein said opaque skin obstructs public viewing of the mother's breast and the nursing infant.

2. A nursing apron as recited in claim 1, wherein said viewing panel includes a plurality of gather means for fitting said viewing panel to the mother's shoulders.

3. A nursing apron as recited in claim 1, wherein said skirt comprises overlapping panel members juxtaposed the mother's breasts and wherein said skirt includes a plurality of vertically disposed openings.

4. A nursing apron as recited in claim 1, wherein said skirt further includes a centrally disposed pleat.

5. A nursing apron for covering the upper portion of a mother's body and an infant during the act of breast-feeding, comprising:

(a) a neck band, said neck band having first and second ends and top and bottom edges, said neck band including means for securing the apron around the mother's neck and for varying the size of the neck band;

(b) a transparent viewing panel comprising an air permeable material, said viewing panel having top and bottom edges, said viewing panel affixed to and extending downward from the bottom edge of said neck band, said viewing panel disposed to extend across the mother's upper chest below the neck, between her shoulders and above her breasts, and to cross the mother's line of sight from her eyes to her breasts;

(c) said viewing panel including a plurality of gather means for fitting said viewing panel to the mother's shoulders; and (d) an opaque skirt, said skirt affixed to the bottom edge of said viewing panel, said skirt draping downward from said viewing panel and disposed to cover at least the mother's middle front torso region and her infant during the act of breast feeding, wherein said viewing panel allows the mother downward unobstructed viewing of the infant and the infant upward unobstructed viewing of the mother and wherein said opaque skirt obstructs public viewing of the mother's breast and the nursing infant.

6. A nursing apron as recited in claim 5, wherein said skirt comprises overlapping panel members juxtaposed the mother's breasts and wherein said skirt includes a plurality of vertically disposed openings.

7. A nursing apron as recited in claim 6, wherein said skirt further includes a centrally disposed pleat.

8. A nursing apron for covering the upper portion of a mother's body and an infant during the act of breast-feeding, comprising:

(a) a neck band, said neck band having first and second ends and top and bottom edges, said neck band including means for securing the apron around the mother's neck and for varying the size of the neck band;

(b) a transparent viewing panel comprising an air permeable material, said viewing panel having top and bottom edges, said viewing panel affixed to and extending downward from the bottom edge of said neck band, said viewing panel disposed to extend across the mother's upper chest below her neck, between her shoulders and above her breasts, and cross the mother's line of sight from her eyes to her breasts;

(c) said viewing panel including a plurality of gather means for fitting said viewing panel to the mother's shoulders; and (d) an opaque skirt, said skirt affixed to the bottom edge of said viewing panel, said skirt draping downward from said viewing panel and disposed to cover at least the mother's middle from torso region and her infant during the act of breast feeding, said skirt comprising a plurality of overlapping panel members juxtaposed the mother's breasts, said skirt including a plurality of vertically disposed openings and a centrally disposed pleat, wherein said viewing panel allows the mother downward unobstructed viewing of the infant and the infant upward unobstructed viewing of the mother, wherein said opaque skirt obstructs public viewing of the mother's breast and the nursing infant, and wherein said overlapping panel members and vertically disposed openings allow the mother access to her infant beneath said nursing apron.

* * * * *